US006138598A

United States Patent [19]

Askestad et al.

[11] Patent Number: 6,138,598

[45] **Date of Patent: *Oct. 31, 2000**

[54] METHOD AND MEANS TO DIRECT AN ANCHORED FLOATING STRUCTURE AGAINST THE DIRECTION OF THE WAVES IN OPEN SEA

[75] Inventors: Sigmund Askestad, Sætre; Finn Gunnar Nielsen, Bønes, both of Norway

[73] Assignee: Norsk Hydro ASA, Oslo, Norway

[ * ] Notice: This patent issued on a continued prosecution application filed under 37 CFR 1.53(d), and is subject to the twenty year patent term provisions of 35 U.S.C. 154(a)(2).

[21] Appl. No.: 08/930,177

[22] PCT Filed: Apr. 17, 1996

[86] PCT No.: PCT/NO96/00088

§ 371 Date: Dec. 23, 1997

§ 102(e) Date: Dec. 23, 1997

[87] PCT Pub. No.: WO96/33090

PCT Pub. Date: Oct. 24, 1996

[30] Foreign Application Priority Data

Apr. 19, 1995 [NO] Norway ..... 951479

[51] Int. Cl.[7] ..... B63B 21/00

[52] U.S. Cl. ..... 114/230.12; 114/230.1

[58] Field of Search ..... 114/230, 293, 114/144 R, 144 C, 146, 162, 144 B, 102.32, 230.12, 230.1

[56] References Cited

U.S. PATENT DOCUMENTS

| | | | |
|---|---|---|---|
| 1,582,391 | 4/1926 | Flettner | 114/162 |
| 3,191,201 | 6/1965 | Richardson et al. . | |
| 3,774,562 | 11/1973 | Dean, III . | |
| 4,089,287 | 5/1978 | Kranert et al. . | |
| 4,273,066 | 6/1981 | Anderson | 114/230 |
| 4,848,258 | 7/1989 | Priebe | 114/102.32 |

FOREIGN PATENT DOCUMENTS

| | | | |
|---|---|---|---|
| 172736 | 3/1994 | Norway . | |
| 1344981 | 1/1974 | United Kingdom | 114/162 |
| 2021062 | 11/1979 | United Kingdom . | |

*Primary Examiner*—Ed Swinehart
*Attorney, Agent, or Firm*—Wenderoth, Lind & Ponack, L.L.P.

[57] ABSTRACT

Method and means to direct an anchored floating structure (1) against the direction of the waves, where said structure at its fore end is moored to a buoy or the like. The floating structure is provided with one or more turnable wind rudder(s) (5) at its aft end, where said rudder(s) may be adjusted versus the direction of the wind in a manner that secures to direct the floating structure against the direction of the waves in a stable manner. The wind rudder or rudders (5) sections may advantageously have a wind profile- or a droplet-like shape.

11 Claims, 4 Drawing Sheets

METHOD AND MEANS TO DIRECT AN ANCHORED FLOATING STRUCTURE AGAINST THE DIRECTION OF THE WAVES IN OPEN SEA

BACKGROUND OF THE INVENTION

The present invention relates to a method and apparatus for directing a floating structure against the direction of the waves, where the structure is anchored or moored to a buoy at its fora end (in front of the midship area). A floating structure may here include any kind of ship, vessel, boat or floating construction that is designed for use in open waters.

Oil and gas obtained from underground reservoirs at sea, for instance the North Sea, are at present commonly transported to installations on the shore, such as refinery and storage tanks, by means of pipelines arranged on the sea bed. In addition, significant quantities of oil and gas are transported by ship, in particular oil and gas produced at small, distant fields that are not brought into communication with the existing pipe system on the sea bed.

When using a ship for this kind of transport, the ship is connected or moored to a buoy that is anchored close to a platform or a subsea storage installation where the oil or the gas is stored. The oil or gas is transferred from the storage installation to the ship by means of one or more pipe lines provided through the buoy.

Storage and production ships have been gradually employed for storage and production of oil and gas from small fields at sea, or fields where the depth of the sea makes the use of installations resting on the sea bed inconvenient or impossible. Ships of this kind are anchored by means of a turret that most commonly is arranged in the fore end of the ship hull.

In bad weather with strong winds, sea currents and heavy seas, the forces acting on the ship, buoy and moorings may become extremely strong. In particular, strong forces act upon ships that are allowed to swing freely about a mooring point (buoy, anchor or the like) with large amplitudes from one side to the other.

In the open sea, the dominant forces acting on a ship that is moored to swing freely are normally sustained by wave forces. The larger the amplitude of the swinging motion becomes, the more the ship will be influenced by the waves. This is followed by large horizontal movements and forces, and also heave and roll motions that cause heavy loads, resulting in wear and damage of the ship and mooring.

Previously, it was known to direct an anchored ship against the direction of the waves by means of side thrusters arranges in the aft end of the ship. However, such installations are expensive, and represent additional costs in connection with maintenance and repair works.

Furthermore, it is common knowledge in connection with boats, in particular in connection with small fishing boats equipped for fishing with lines or nets, to employ a spanker. A spanker is a sail that is supported by a mast at the aft end of a boat, and it serves to keep the boat against the direction of the wind, and to reduce the rolling motion of the boat. When hauling fishing gear such as nets or lines, it is important to keep the boat against the direction of the wind to avoid the boat drifting across the fishing gear. Thus, a spanker is a sail that is arranged in a direction normally (except when sailing) parallel with the boat.

While a ship is anchored or moored to a buoy or the like in the open sea to load or to produce oil or gas, the primary task is to keep the shop against the direction of the waves in a stable manner, as previously mentioned, to avoid having the ship start swinging (yaw motions) with large amplitudes that may cause heavy loads on the moorings. In addition, large amplitudes of rolling motion may be avoided when the ship is positioned with little directional variation.

SUMMARY OF THE INVENTION

The present invention provides a method and a device that solve the above problems. According to the present invention, the method is characterized in that the floating structure is provided with a wind rudder at its aft end that is adjusted versus the wind direction such that the floating structure is directed against the direction of the waves.

Furthermore, according to the invention the device is characterized in the arrangement of a turnable, preferably positively driven, wind rudder that is adapted to be adjusted in any desired angular position according to the longitudinal axis of the ship.

BRIEF DESCRIPTION OF THE DRAWINGS

In the following, the invention is described in detail with reference to drawings that illustrate embodiments thereof, in which:

FIG. 3 illustrates one theoretical situation for a ship moored by means of a turret, as shown in FIG. 1(*a*), where the wind and the waves are coming toward the ship at different directions, FIGS. 4(*a*) and 4(*b*) show, based upon model experiments, a graphic presentation of:

Figure 1A:
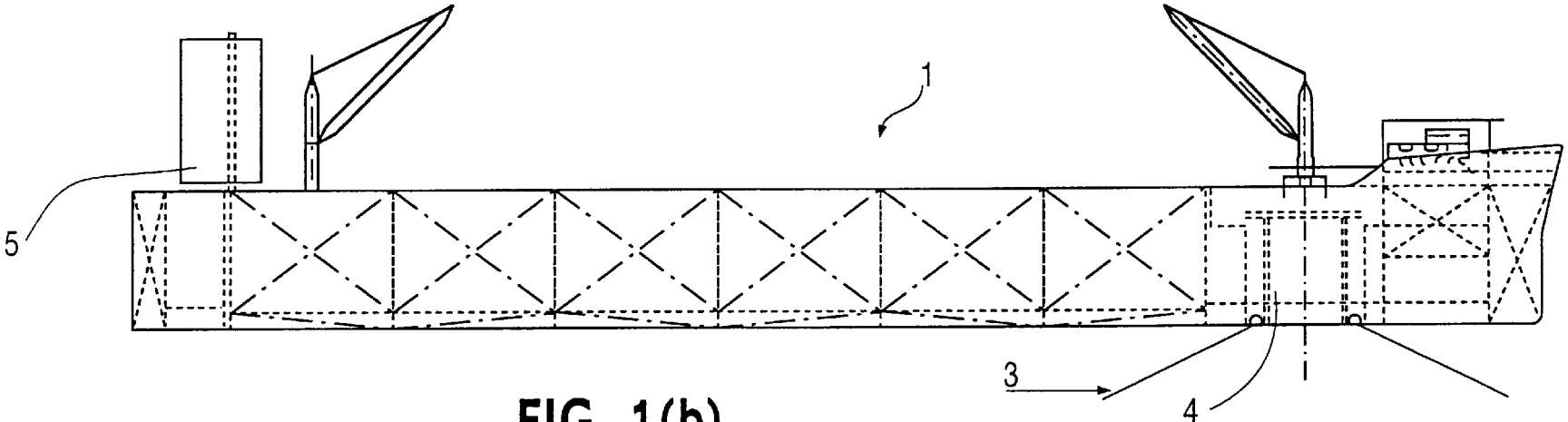
FIGS. 1(*a*) and 1(*b*) show in side and top views respectively, a ship provided with a wind rudder according to the invention, FIGS. 2(*a*) and 2(*b*) show one embodiment of a wind rudder included in the invention.

a) the yaw motion of a model boat as wind direction versus the direction of sea current and waves is 20 degrees, and where the model boat is not provided with a wind rudder, and b) the yaw motion of the same model boat as above, as wind direction versus the direction of sea current and waves is 20 degrees, and where the boat is provided with a wind rudder arranged at an angle of 30 degrees with the length axis of the boat, respectively.

DETAILED DESCRIPTIONS OF THE PREFERRED EMBODIMENT

As mentioned above, FIGS. 1(*a*) and 1(*b*) show a ship 1 in side and top view. At its fore end the ship is provided with a turret 4 that is arranged in the hull for turning motion and that is moored to the sea bed by means of anchor lines 3 (not further shown). Thus, the ship is arranged to turn or swing freely about the turret.

One essential feature according to the invention, is that there is arranged a turnable wind rudder 5 at the aft end of the ship. The rudder extends above the deck or possible installations at the deck. The wind rudder 5 is preferably driven by means of an electric or a hydraulic motor and is adapted to be turned to any desirable position (angle) relative to the longitudinal axis of the ship. The cross section of the rudder should suitably have the shape of a wing profile or a droplet as shown in the drawing to achieve an increase "lift" and a reduced air resistance. On the other hand, other shapes may be employed, such as a planar or approximately planar shape.

Figure 2A:
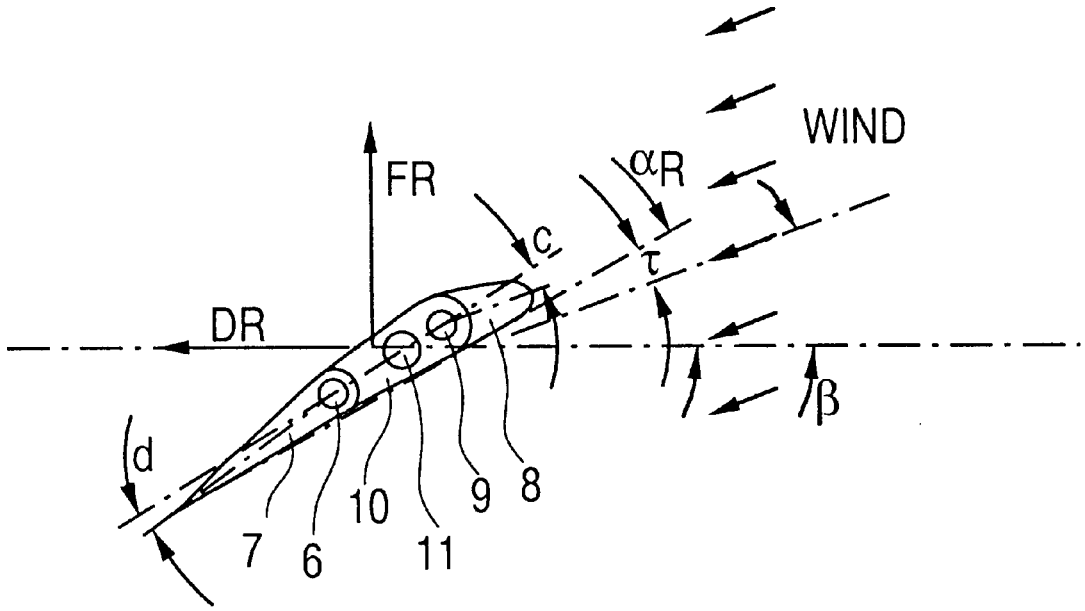
Figure 2B:
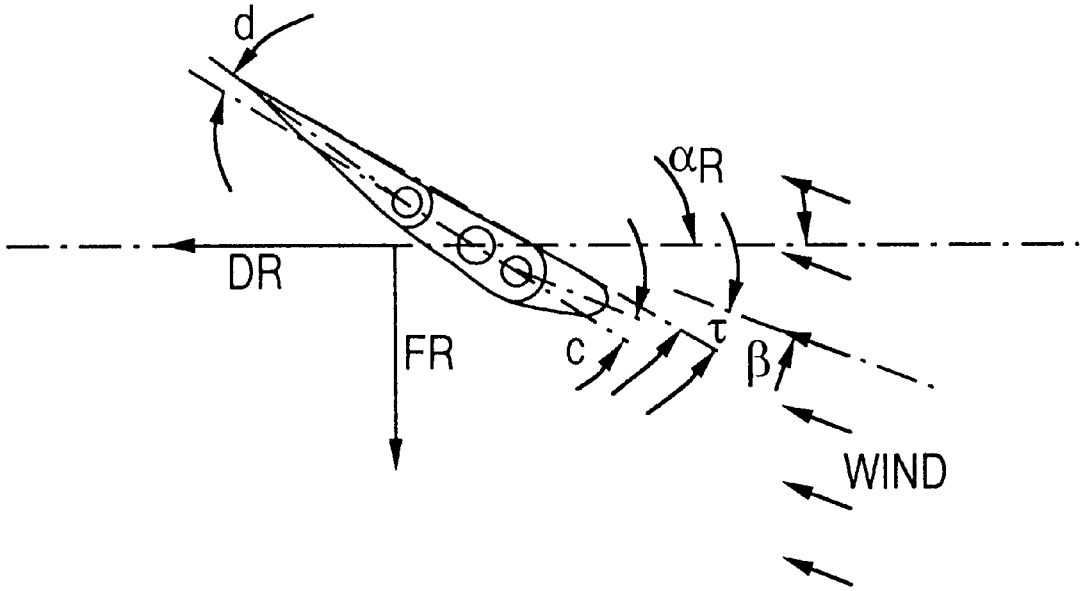

FIG. 2 shows the cross section of an alternatively shaped rudder having a form such that an approximate lifting surface effect is achieved for wind directions coming in from both sides of the ship. The following symbols are used in this figure:

$\alpha_R$=Rudder direction relative to vessel

β=Wind direction relative to vessel

τ=Wind direction relative to rudder c=Direction of fore fin relative to rudder direction d=Direction of aft fin relative to rudder direction FR=Lift force from rudder DR=Drag force from rudder In FIG. 2(*a*) the rudder is shaped to sustain a "lift" to the port side (PS) as the wind comes from the port side of the ship. FIG. 2(*b*) shows in an inverted situation, with the shape of the rudder-profile for the wind coming from the starboard side of the ship and a "lift" to the starboard side being desired. Such a profile sustains a large "lift" even at an attach angle of 0 degrees, and represents a maximum force in its transverse direction at approximately 8–15 degrees depending on the shape of the profile.

The rudder is divided into three hinged sections that may be swung with respect to each other in a manner that allows the centerline of the profile to form a curve that describes the form of the wing. It has a main section 10 that is allowed to turn about a mast 11 supported by the ship 1. A foremost section 8 of the profile, the "leading edge", is allowed to turn about an axis 9. A rear section 7, the "trailing edge", is allowed to turn about axis 6. Both axis 6 and 9 are fixed to the main section 10.

Waves in the open sea are mainly generated by wind, and generally, under strong windy conditions (gale and stronger), the direction of the waves will be similar to the wind direction within an angular band of 15 to 20 degrees to both sides. This angle may become larger under weak wind conditions because of so called "old sea".

Sea currents are also mainly generated by the wind. This wind generated current will, as a result of the rotation of the earth, advance at a direction up to 20 degrees with respect to the direction of the wind. However, there may be contributions to this current caused by tidal, global (the Gulf current) and local currents. In such matters the angle between the current and the waves may become up to 40–60 degrees, even under strong wind conditions.

As wind and current generally act at an angle that differs from the wave direction, a ship not provided with a wind rudder will be oriented at an average direction that differs from the wave direction. The wave forces will then be significant as the waves, as mentioned above, will cause heavy loads in the transverse direction of the ship. Moreover, waves vary a lot over the course of time, and thus the ship will perform large yaw motions that cause heavy dynamic loads on the mooring.

Figure 1B:
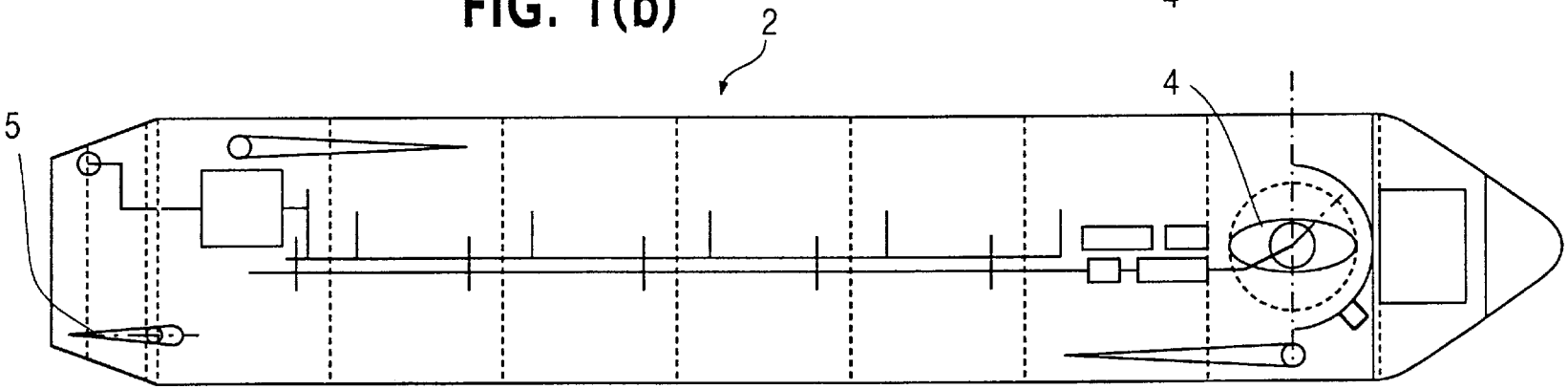
Figure 3:
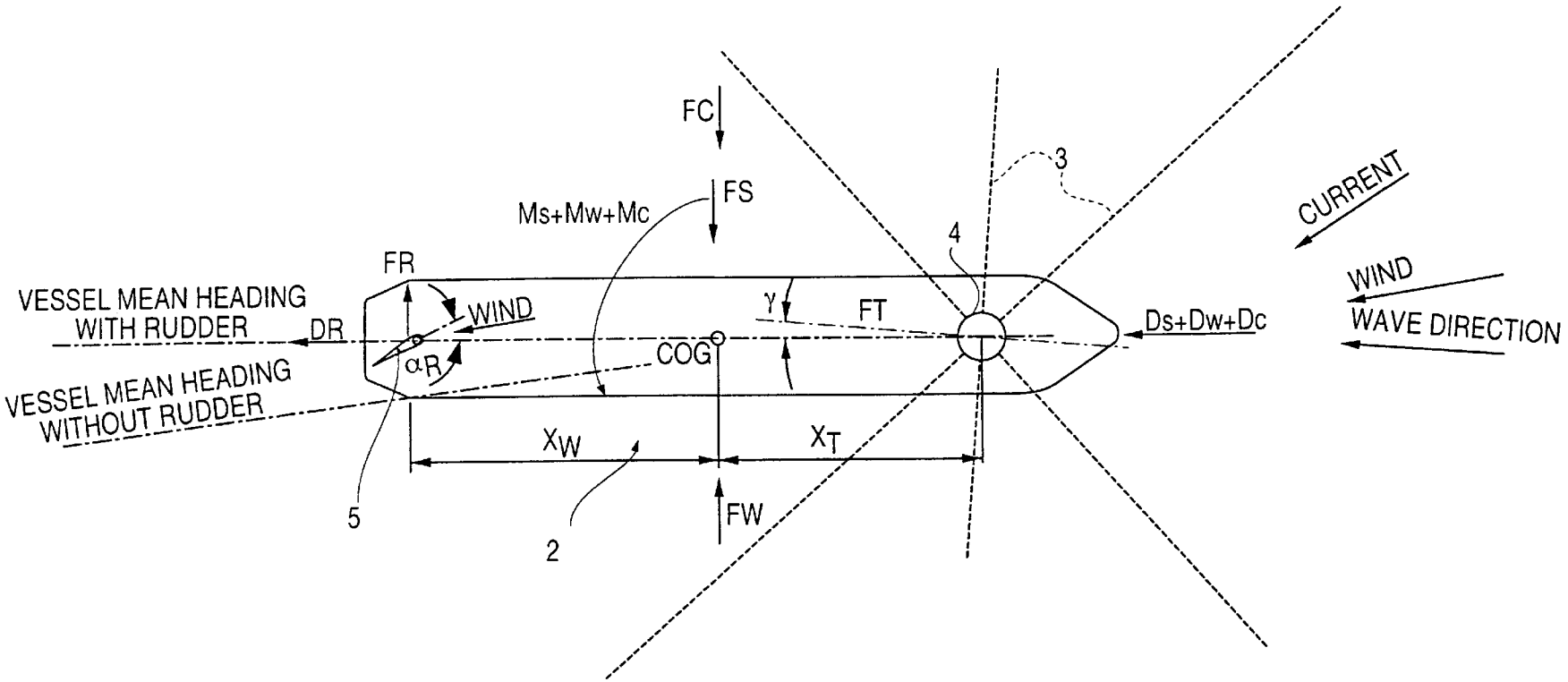

FIG. 3 illustrates a theoretical situation where a ship is moored by means of a turret, as shown in FIG. 1, and where the wind and the waves are coming towards the ship at different directions, as indicated by arrows. The symbols in this figure are as follows:

Fs=Transversal component of wind force on vessel

Fc=Transversal component of current loads on vessel

Fw=Transversal component of wave force on vessel

Ds=Longitudinal component of wind force on vessel

Dc=Longitudinal component of current loads on vessel

Dw=Longitudinal component of wave force on vessel

Ft=Turret mooring force

γ=Vessel direction relative to wave heading

Ms=Yaw turning moment of wind force on vessel

Mc=Yaw turning moment of current loads on vessel

Mw=Yaw turning moment of wave forces on vessel

FR=Transversal ship component of wind force on wind rudder

DR=Longitudinal component of wind force on wind rudder

CDG=Center of gravity on vessel

The force arrows as indicated by $F_w$, $F_c$, and $F_s$ represent the transversal component of the forces originated by waves, current and wind respectively, that act upon the ship. $F_R$ and $D_R$ represent the transversal and longitudinal components of the wind forces acting on the wind rudder.

The longitudinal components of the wind, wave and current forces that act on the ship are similarly indicated by the force arrow marked $D_s+D_w+D_c$. Wind, waves and current will in addition cause yaw force of momentum (about the vertical axis of the ship), as represented in the FIG. by an arrow marked $M_s+M_w+M_c$ that acts about the center of gravity (COG) of the ship. The magnitude of the forces and the force of momentums that act on the ship depend on the shape of the ship both below and above the sea level, and on the relative direction between the ship and wind, waves and current.

The mooring force, marked by $F_R$, acts through the enter of the turret. The forces of momentum acting in connection with turret mooring systems are generally of such a small magnitude that they can be neglected.

A ship may be defined as being moored in a directionally unstable manner if it is altered from one initial position to another position significantly different from the initial position by the influence of minor transversal force (disturbance). This feature is characteristic for a static unstable situation. A dynamic unstable situation is characterized by that the ship will start turning (yaw) with an increasing amplitude if the ship is given a small transversal disturbance (influenced by a force in a limited period of time).

The forces that may generate unstable behavior of the ship may be originated by wind, waves, current or other kinds of influences that act on the ship. A moored ship is stable or unstable, with respect to its direction, in dependence of the coefficients of transversal forces and torques that are originated by wind, waves and current together with the location of the turret and its mooring forces. The dynamic directional stability criterion is in addition determined by the moment of inertia of the ship with respect to yaw motions and transversal movements of the ship.

The magnitude of the forces originated by waves, wind and current that act on the ship depend on the geometry of the ship and its average direction with respect to the direction of waves, wind and current. In a given situation, if the ship is directionally unstable, large yaw motions must be anticipated, as mentioned above. If, in case the ship is directionally stable, the feedback force (from wind, current and waves) will generally be small in comparison with the inertia forces of the ship. Thus, the response period for the yaw motion will become long, 100 seconds and more, depending on the wind, current, and wave forces. This implies, in addition, that if one force component (e.g. the wave force) alters in magnitude or direction, the direction of the ship may alter significantly. In particular, the yaw motion will be influenced by (slowly varying) wave forces.

As the wind often acts in a direction that differs with respect to the direction of the waves, and also represents the most dominant force influencing the direction of the ship, the average direction of a ship not provided with a wind rudder will mainly be determined by the direction of the wind. Thus, the direction of the ship will be somewhat biased with respect to the direction of the waves. This is an unfavorable situation, as waves coming against the bow of a ship at a biased direction cause large dynamic forces that generate yaw motions, resulting in very high and dynamic loads in the mooring lines of the anchored ship. Waves coming against the ship at an oblique angle may in addition cause large roll motions of the ship.

The use of one or more wind rudders (i.e. at least one) will, according to the invention, provide a force that acts in a direction that is inverse as to the sum of the forces FW, FC and FS, and that contributes to the following:

improving the directional stability of the ship as the rudder acts to augment the "yaw angle spring stiffness" of the ship, an augmentation in the forces that will turn the ship back to an average direction after a swing-out, and altering the average direction of the ship in such a manner that the direction of the waves versus the bow will be from straight ahead, whereby the dynamic forces that both influence the yaw angles of the ship and the average wave load will be decreased.

The wind rudder may be adjusted and controlled in alternative manners, for instance by:

periodical adjustment of the rudder in accordance with changes in the average direction of the ship versus wind and waves, or continuous adjustment of the rudder that in addition take into account the yaw motions of the ship for maximum utilization of the capacity of the rudder.

Further, the rudder should be dimensioned to sustain a transverse force that is sufficiently strong to keep the bow of the ship up against the waves under the most probable load combinations of wind, waves and current for both loaded and ballasted draught.

Furthermore, the adjustment and the control of the rudder may be performed manually, or automatically in a manner similar to that of a side thruster in a dynamically positioned ship, by means of data control based on continuous records of for instance the direction of the ship, wind, current and waves.

Experiments were performed with a model boat moored with a turret, and where the boat was provided with a fixed wind rudder according to the invention. The experiments were performed in a model tank where waves propagated at a direction that was 20° versus the direction of the wind, and where the direction of the current was similar to that of the waves. The wind rudder was fixed in a position that formed an angle of 30° with the length axis of the model boat, and had an area that was approximately 20% of the surface water cross sectional area of the boat.

In the course of the experiments, the boat positioned at an averaged angle of 3.3° versus the direction of the waves, and thus the angle of attack of the wind versus the wind rudder was 30−20+3.3=13.3°. Under these conditions, the maximum yaw angle of the boat was 11.43°, while the minimum yaw angle was −4.1°. In the last mentioned case, the angle of attach of the wind versus the wind rudder was 30−20−4.1=5.9°, and in the first mentioned case the similar angle was 30−20+11.4=21.4°.

Experiments with a model boat not provided with a wind rudder were also carried out. In these experiments the directions for the wind and the waves were the same as above. In this situation, the boat had an average angle of 13° versus the direction of the waves. Furthermore, the maximum yaw angle was 28° and the minimum yaw angle was 0.4°.

Figure 4A:
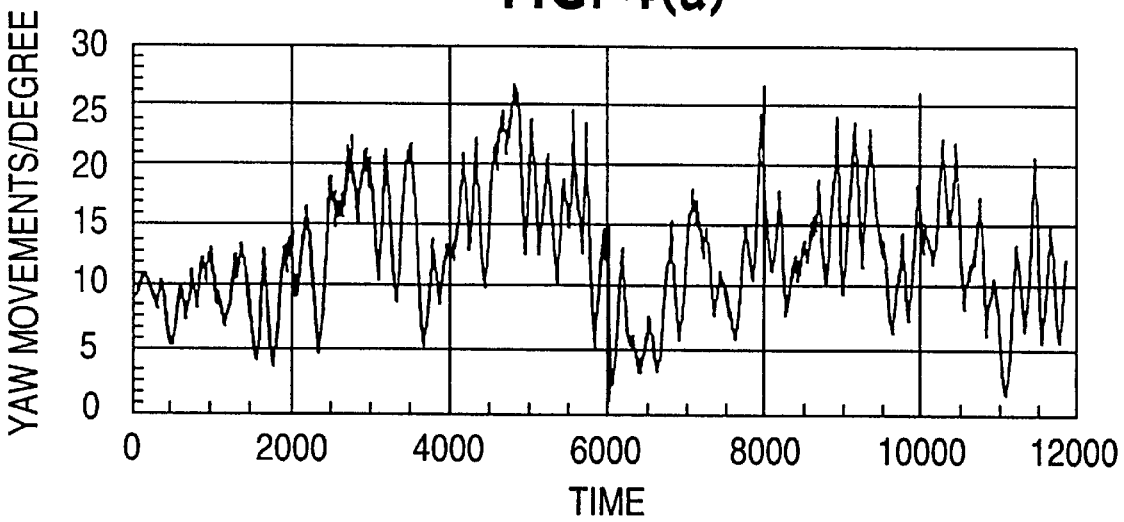
Figure 4B:
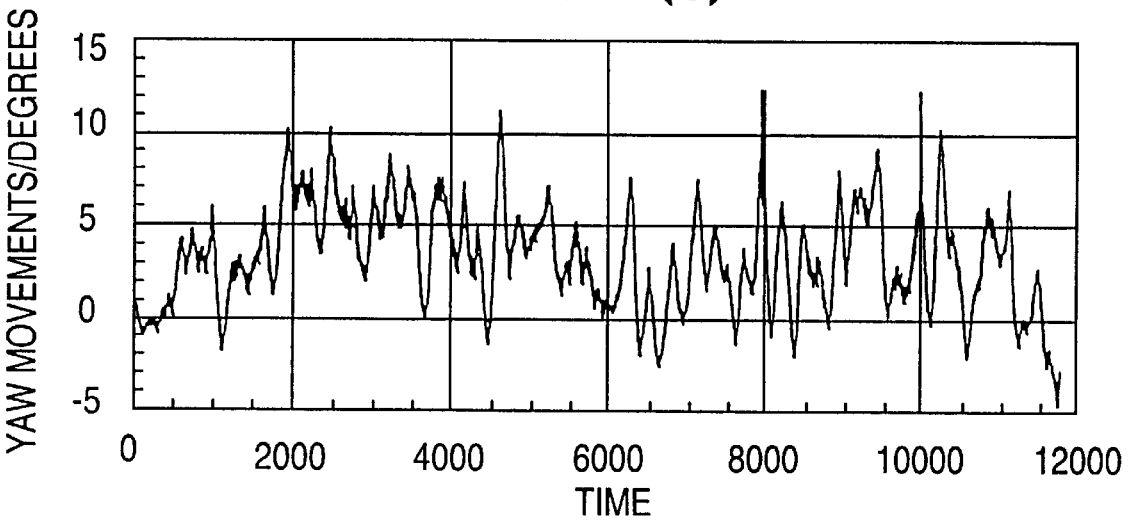

FIGS. 4(*a*) and (*b*) show a graphic presentation of the yaw motions of the boat, respectively without and with a wind rudder, as recorded for a period of time under the experiments.

As follows from the values of the digits above and of FIGS. 4(*a*) and (*b*), the yaw motions (the swinging motion from side to side) are substantially smaller for the boat provided with a wind rudder. In this manner, the differences between largest yaw amplitudes are more than 30%. This reduction of yaw amplitude also resulted in a reduction of the mooring loads, that were measured to be about 25% for the boat provided with a wind rudder. However, as concerns the wind rudder that was applied in the experiments, it should be mentioned that this rudder was not optimized either with regards to size or shape. Meanwhile, the results of the experiments illustrate the positive influence on the movements and forces that exclusively will be obtained by applying a wind rudder according to the present invention.

What is claimed is:

1. A method of directing an anchored floating structure, comprising:

anchoring the floating structure at a fore end of the floating structure; and adjusting at least one pivotal wind rudder provided at an aft end of the floating structure with respect to the direction of the wind such that the floating structure is directed against the direction of the waves in a stable manner due to force on the floating structure generated by the wind and the at least one wind rudder;

wherein said adjusting comprises pivoting said at least one pivotal wind rudder so as to provide a force acting on the floating structure inverse in direction to the sum of forces on the floating structure transverse to the longitudinal centerline of the floating structure due to wind, waves and currents; and wherein said adjusting is carried out to direct the floating structure against the direction of the waves in a stable manner even when the directions of the wind, waves and currents are not the same.

2. The method of claim 1, wherein:

said adjusting comprises pivoting said at least one pivotal wind rudder with a motor.

3. An anchored floating structure, comprising:

a floating structure having a longitudinal axis and a fore end that is anchored at sea and subject to wind, waves and currents; and means on an aft end of said floating structure for directing said floating structure against the direction of the waves even when the directions of the wind, waves and currents are not the same by using the wind to provide a force to said floating structure;

wherein said means comprises at least one pivotal positively driven wind rudder capable of being pivoted to different angles with respect to the longitudinal axis; and wherein said means for directing said floating structure adjusts said at least one pivotal wind rudder with respect to the direction of the wind such that the floating structure is directed against the direction of the waves in a stable manner.

4. The anchored floating structure of claim 3, wherein said at least one wind rudder has a shape in cross section selected from the group consisting of wing shaped and droplet shaped.

5. The anchored floating structure of claim 4, wherein said at least one rudder each comprises three hinged sections that are pivotal with respect to each other.

6. The anchored floating structure of claim 5, wherein said three hinged sections comprise a front section, a center section and a rear section, said front section being pivoted to a front end of said center section, said center section being pivoted to said floating structure, and said rear section being pivoted to a rear end of said center section.

7. The anchored floating structure of claim 5, wherein said three hinged sections form a camber.

8. The anchored floating structure of claim 3, wherein said at least one rudder each comprises three hinged sections that are pivotal with respect to each other.

9. The anchored floating structure of claim 8, wherein said three hinged sections comprise a front section, a center section and a rear section, said front section being pivoted to a front end of said center section, said center section being pivoted to said floating structure, and said rear section being pivoted to a rear end of said center section.

10. The anchored floating structure of claim 8, wherein said three hinged sections form a camber.

11. The anchored floating structure of claim 3, wherein said means for directing is for pivoting said at least one pivotal wind rudder so as to provide a force acting on the floating structure inverse in direction to the sum of forces on the floating structure transverse to the longitudinal centerline of the floating structure due to wind, waves and currents.

* * * * *